United States Patent [19]

Russell

[11] Patent Number: 4,504,197

[45] Date of Patent: Mar. 12, 1985

[54] PUMPING UNIT AND REVERSING VALVE AND METHOD OF OPERATING

[76] Inventor: Carl D. Russell, Box 334, Sallisaw, Okla. 74955

[21] Appl. No.: 327,065

[22] Filed: Dec. 3, 1981

[51] Int. Cl.[3] ..... F04B 17/00

[52] U.S. Cl. ..... 417/404

[58] Field of Search ..... 417/404, 403; 91/228, 91/229

[56] References Cited

U.S. PATENT DOCUMENTS

| | | | |
|---|---|---|---|
| 2,042,300 | 5/1936 | Forsberg | 91/228 X |
| 2,051,371 | 8/1936 | Erling | 91/228 X |
| 2,748,712 | 6/1956 | Sargent | 417/404 X |
| 3,010,439 | 11/1961 | Mee et al. | 91/229 X |
| 4,087,206 | 5/1978 | Russell | 417/53 |

*Primary Examiner*—Leonard E. Smith

*Attorney, Agent, or Firm*—Wilfred G. Caldwell

[57] ABSTRACT

The invention relates to apparatus for and a method of remotely reversing the operation of a power piston in a power cylinder automatically to pump oil, corrosive or wax bearing fluids in response to unidirectional high pressure flow. The flow of high pressure fluid driving the piston in one direction may be reversed in the piston to drive the piston in the opposite direction at the end of the respective strokes by establishing collapsible chambers for the high pressure fluid within the piston. Each chamber is collapsed toward the end of alternate strokes by the reversing piston striking a stop slightly before the end of the stroke to partially collapse said chamber as a result of further movement of the power piston. At the conclusion of each stroke, all valving is closed and the high pressure entering the collapsed chamber now exerts force against the reversing piston, but since the reversing piston is against the stop, the force is oppositely directed to reverse the direction of the power piston. A rigid rod extends between the reversing pistons, having a length to prevent both chambers from collapsing at the same time. This insures that upon reversal of the power piston, the forward moving reversing chamber is not collapsed, and therefor no energy is lost in moving its reversing piston outwardly.

23 Claims, 18 Drawing Figures

PUMPING UNIT AND REVERSING VALVE AND METHOD OF OPERATING

TECHNICAL FIELD OF THE INVENTION

The invention relates to improved deep well pumps, and more particularly to such pumps incorporating novel reversing valve arrangements responsive to unidirectional high pressure fluid flow to reciprocate a power piston.

BACKGROUND OF THE INVENTION

My prior U.S. Pat. No. 4,087,206 issued May 2, 1978 also scavenges oil from oil wells extending down into the earth. However, the concept of the present invention uniquely includes collapsible chambers at the outer ends of the power piston with means for preventing the simultaneous collapse of the chambers, such that upon reversal of the power piston when one reversing chamber is collapsed, the opposite chamber is maintained uncollapsed, thereby avoiding energy expenditure in uncollapsing the new forward moving chamber on the opposite or succeeding power stroke. Thus, a much more efficient concept is implemented.

Generally, the recovery system employs a hydraulically operated motor in combination with a fluid pump for insertion into the deep well, where at least the pump is submerged, and fluid is forced down a tubing to power the motor piston, and the pump recovers production fluids on each up and down reciprocal stroke, such that two (2) gallons of production fluid may be pumped to a farm tank for each gallon of operating fluid pumped down to the motor.

BRIEF SUMMARY OF THE INVENTION

The reversing valve of the present invention enables remote automatic reversing of the motor at the end of each stroke as to reciprocate the pump from the unidirectional flow operating fluid pumped down from the surface. This valve comprises a power piston in a power cylinder housing with a portion of the power piston being a movable member comprising an exhaust valve portion and an inlet valve portion disposed within the piston.

Within the power piston there is located opposed, spaced apart reversing chambers carried by the movable member, each having a reversing piston respectively extending in opposite directions longitudinally of the power piston. The power cylinder includes stop means, against which the reversing pistons abut, prior to the end of a stroke. This results in an inward displacement, on alternate strokes, of the reversing pistons, relative to the power piston to collapse the opposite chambers on alternate strokes due to the power piston completing its stroke while the reversing piston is stopped.

Rigid means prevents collapse of the opposite chamber by extending between reversing pistons and being of a length to preclude both chambers from collapsing at the same time. The rigid means also switch the inlet high pressure into the collapsed chamber, to force the movable member and the rigid member away from the stopped piston to initiate the opposite power stroke. Less area of the power piston must be returned against the high pressure thereby increasing the pump motor efficiency.

BRIEF DESCRIPTION OF THE DRAWINGS

In FIG. 1 a housing 11 includes an upper motor portion 13 and a lower pump portion 15, with an intermediate outlet portion 17.

Figures 1, 2, 2A, 2B, 2C, 2D, 3, 3A, 3B, 3C, 9, 9A:
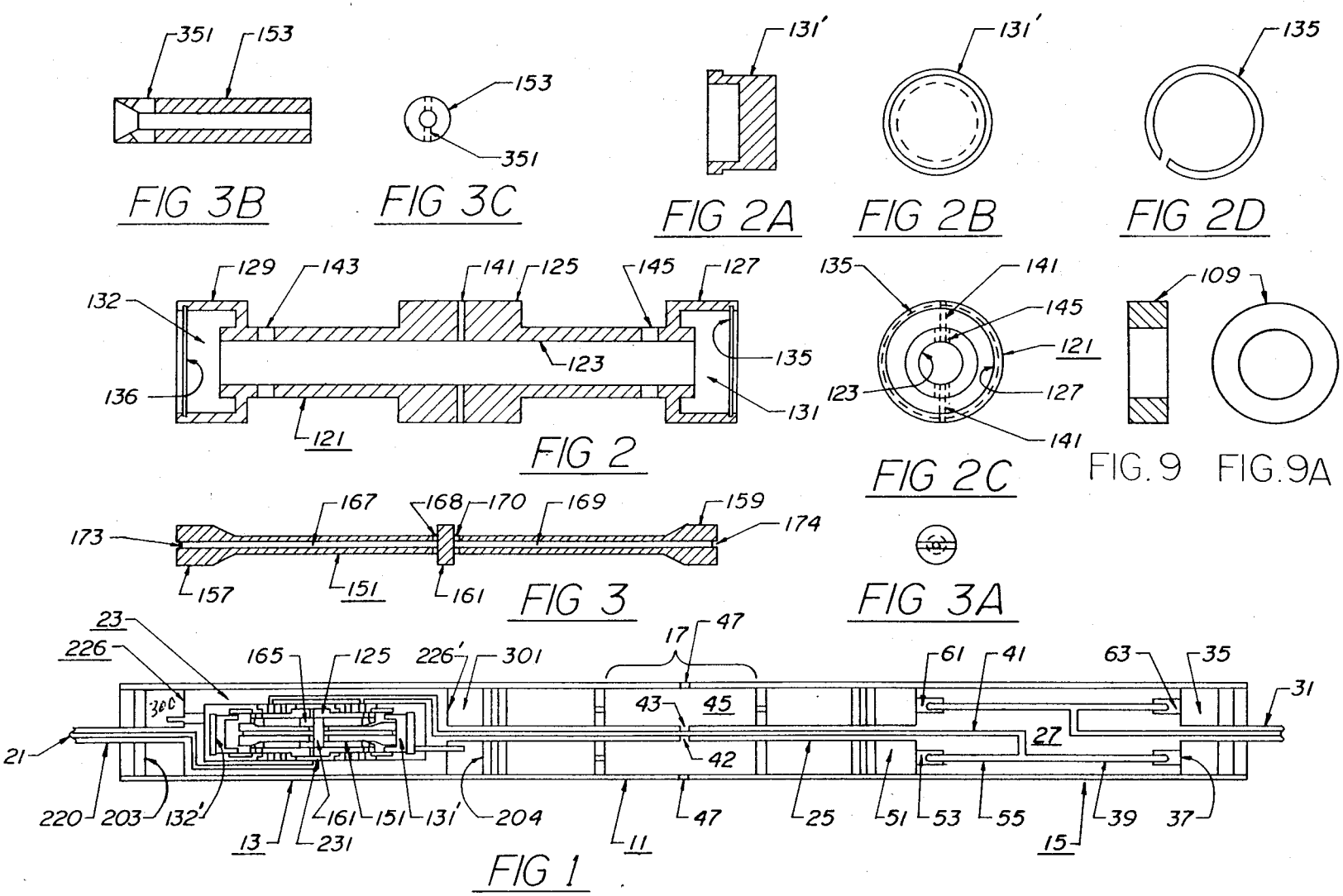
FIG. 1 is a longitudinal sectional view through a cylinder housing enclosing a fluid motor and pump.
FIG. 2 is a view in section of the movable valve member.
FIG. 2*a* is a sectional view of a reversing piston.
FIG. 2*b* is a right hand end view of the piston of FIG. 2*a;*
FIG. 2*c* is an end view of the valve member of FIG. 2.
FIG. 2*d* is a retaining ring for the piston.
FIG. 3 is a view in section of the rigid member.
FIG. 3*a* is an end view of the rigid member.
FIG. 3*b* is a view in section of the left hand sleeve for the rigid member.
FIG. 3*c* is a right hand end view of FIG. 3*b;*
FIG. 9 is a sectional view of a divider.
FIG. 9*a* is and end view of a divider.

Driving fluid is pumped from the surface through conduit 21 to operate motor piston 23 reciprocally up and down. A tubular shaft 25 rigidly connects motor piston 23 to pump piston 27 for like reciprocal movement.

The pump 15 is at least partially submerged in the production fluids to be pumped to the surface via inlet conduit 31. As pump piston 27 moves downwardly, fluid in chamber 35 is forced to pass through inlet ball valve 37 and via conduits 39 and 41 to tubular conduit 25 which includes peripheral openings, such as 42 and 43, for fluid passage into chamber 45 and thence via peripheral outlets, such as 47, through housing 11 and a conduit not shown to a surface farm tank. Also, as pump piston 27 moves upwardly, the fluid in upper pump chamber 51 passes through inlet ball seat valve 53 and via conduit 55 into common conduit 41 for pumping to the farm tank along the same path previously described.

On the downward stroke, ball seat valve 61 admits fluid to upper chamber 51 via inlet 31 and on the upward stroke via inlet passage through valve 63 into chamber 35.

The valve and valving arrangement of the motor 13 are best depicted in the remaining figures to control the reciprocating pumping action of piston 27 of pump 15.

In FIG. 2, slidable valve member 121 is shown with a bore 123, a cylindrical middle section 125 forming an inlet valve, with the outer ends formed and finished for exhaust valves 127 and 128. These end portions form chambers 131 and 132 to receive pistons, such as 131' (FIG. 2*a*), which then form collapsible chambers for reversing the fluid passages. Lock rings 135 and 136 fit grooves in the interior walls of chambers 131 and 132 to retain the pistons and limit their travel.

Inlet passage 141 admits high pressure fluid to bore 123, whereas exhaust passages 143 and 145 permit fluid to flow from bore 123.

Bore 123 of valve member 121 accomodates rigid member 151 with its sleeves 153 and 155 in sealing slidable engagement therewith, (FIGS. 3 and 3*b*).

Rigid member 151 includes exhaust passage closures in the form of enlarged ends 157 and 159. Intermediate enlarged portion 161 forms a high pressure inlet closure selectively to direct high pressure fluid to either end chamber.

The inner ends of sleeves 153 and 155, which sleeves serve as pressure dividers, form compartment 165 within bore 123 in communication with high pressure inlet passage 141. Enlarged portion 161 is in sealing slidable engagement with bore 123 in compartment 165 (FIG. 4) to direct inlet high pressure either along bore 167 via drilled inlet 168 or bore 169 via opening 170. These bores extend to the collapsible chambers 132, 131 with notched outlet passages 173 and 174 serving to release high pressure thereinto.

Figure 4:
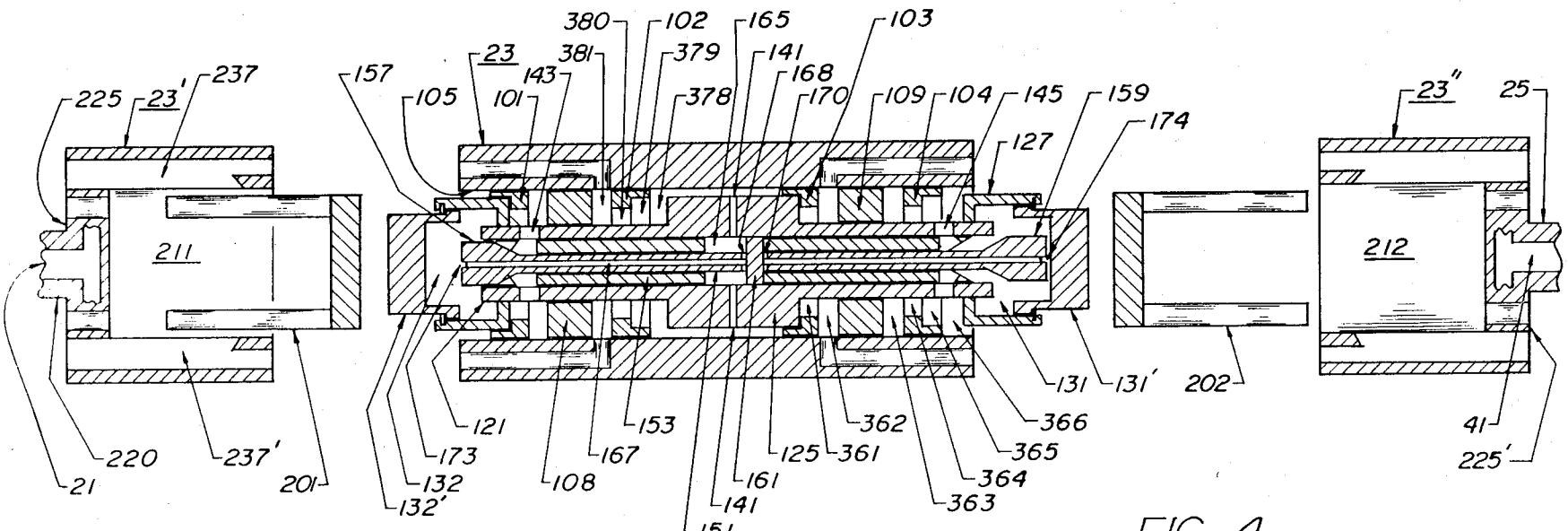
FIG. 4 is a partly exploded view in section of the motor, per se, with FIG. 4*a* being the same structure revolved ¼ turn.
Figure 4A:
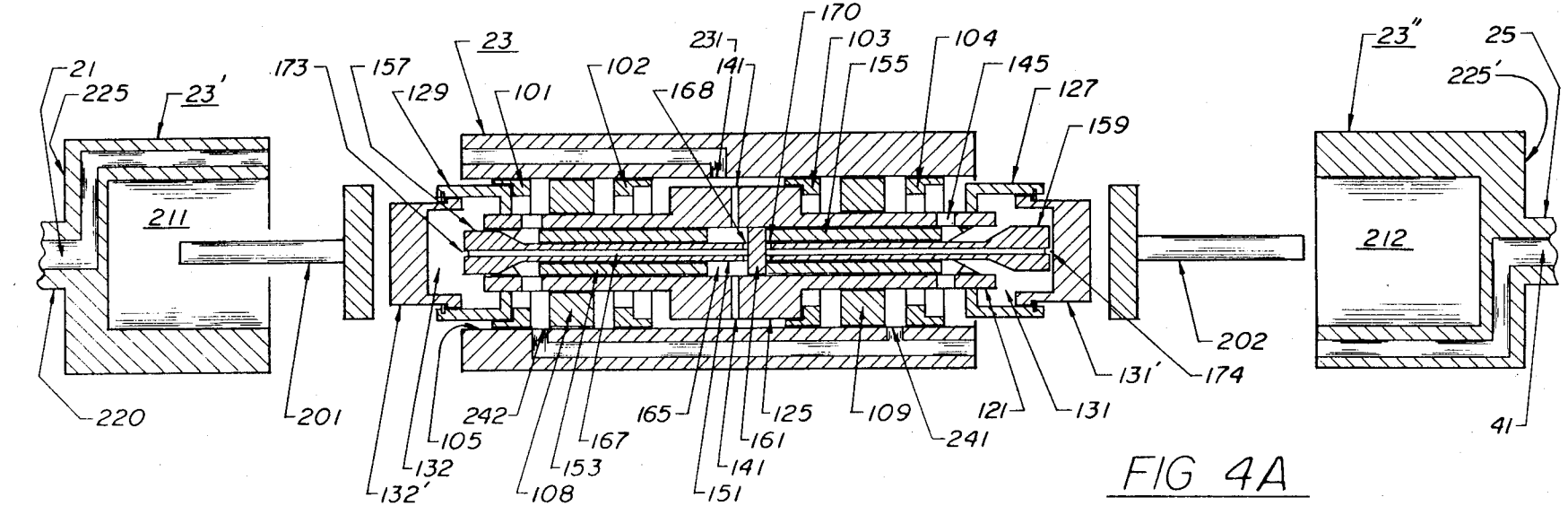

In FIGS. 4 and 4*a*, the structural details of how motor piston 23 serves as a power piston are illustrated with the structure of FIG. 4*a* being revolved one quarter of a turn from that of FIG. 4.

Four ring valve seats 101, 102, 103 and 104 are press fitted within bore 105 of piston 23 to comprise exhaust valve seats 101 and 104 and inlet valve seats 102 and 103. Also, press fitted within bore 105 are dividers 108 and 109 which separate the high pressure from the low pressure inside bore 105. Cylindrical valve member 121 slides in the valve seats 101–104 and is sealingly fitted for slidable motion in the bores of dividers 108 and 109.

The valves 127 and 129 forming the opposite ends of the valve member 121 receive the pistons 131' and 132 closing the collapsible chambers 131 and 132.

U-shaped slides 201 and 202, together with the walls 203 and 204 (FIG. 1) of cylindrical housing 11, form stop means for the pistons 132' and 131' to permit chamber collapse and stroke reversal. The lefthand end 23' and righthand end 23'' of piston 23 are shown exploded in FIGS. 4 and 4*a* to better picture the structure. End 23' forms chamber 211 and end 23'' forms chamber 212 for fluid distribution externally of reversing pistons 132' and 131'.

In FIG. 4*a*, the passage 21 in piston 23 from rod 220 is shown rotated 90° degrees from passage 21 in FIG. 1 (i.e.) passage 21 feeds uni-directional high pressure fluid along the bottom wall of piston 23 in FIG. 1 and along the top wall in FIG. 3.

Figure 5:
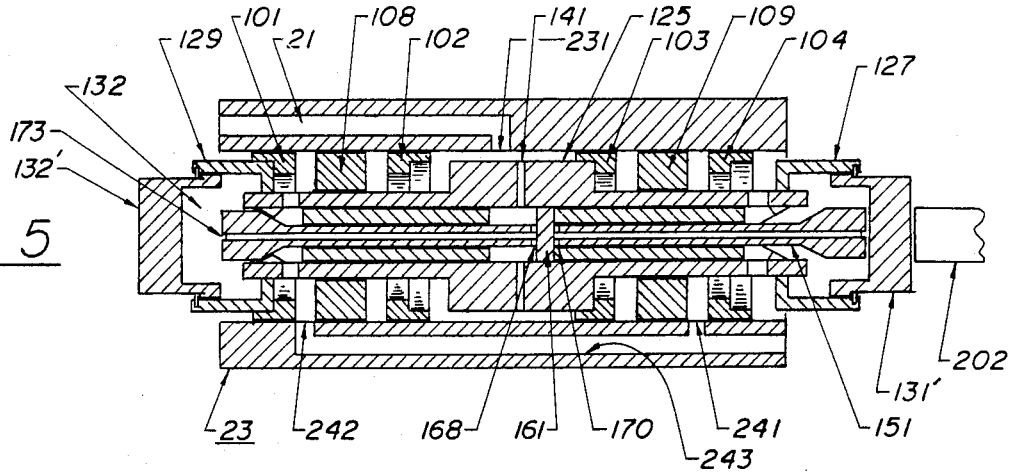
FIG. 5 is a sectional view through the motor with the power piston moving to the right because of high pressure applied to its left end and with the right hand reversing piston stopped.
Figure 6:
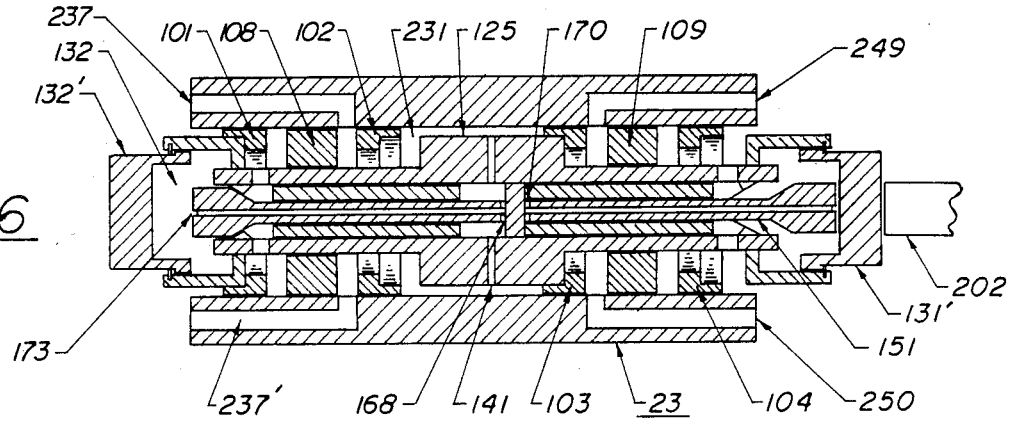
FIG. 6 shows the structure of FIG. 5 rotated e.g. ¼ turn to picture other high pressure and exhaust passages.

Operation of the valving of the power piston will now be described in connection with the illustrations of FIGS. 5 through 8. In FIGS. 5 and 6, the power piston 23 is moving to the right, due to high pressure acting against lefthand end surface 225 (FIGS. 4 and 4*a*), having been directed to chamber 226 (FIG. 1) via conduit 21 in rod 220 which conduit extends along and within the outer wall of power piston 23 to annular inlet chamber 231 (FIG. 5). Inlet valve 125 is closed against annular seat 103 because the valve member 121 and the power piston 23 are being pushed to the right as a result of high pressure fluid (usually a liquid such as oil) passing from chamber 231, under valve seat 102 and along divider 108 to conduit 237 (FIG. 6), the latter figure being rotated a quarter of a turn from FIG. 5. High pressure fluid fills chamber 211 (FIG. 4*a*) via conduits 237, 237' and rushes into housing chamber 300 to push against end 226 of power piston, and also against the valve member 121, high pressure within chamber 132 maintains piston 132' out. This pressure enters chamber 132 by way of inlet valve 125 conduit 141 to rigid rod 151 chamber 165, into bore 167 via opening 168 and along bore 167 to exit into the chamber via notch 173. Exhaust valve 129 is against seat 101, maintaining the high pressure trapped.

The righthand side of power piston 23 is exhausted because valve 127 is away from seat 104, and also exhausts ports 241 and 242 are open into exhaust conduit 243. High pressure passages 249 and 250 are not used on the righthand stroke.

In FIGS. 5 and 6, piston 131 has just reached stop 202, and rod 151 is just abutting piston 131' from the inside. No reversing action has yet taken place.

Figure 7:
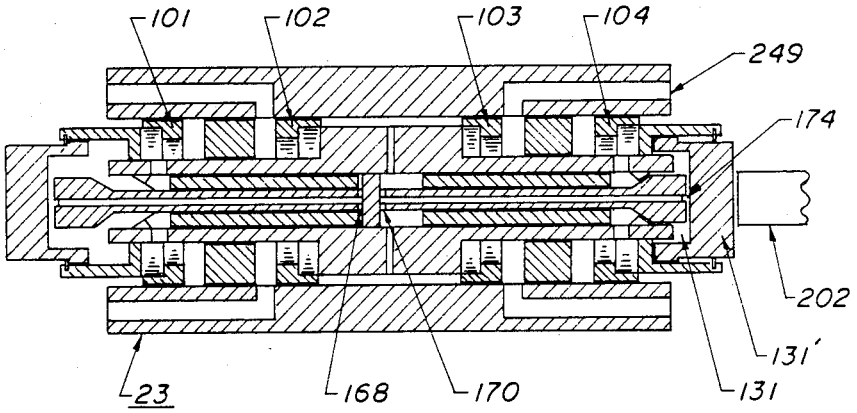
FIG. 7 is a sectional view, as in FIG. 6 but with the power piston moved to the right sufficiently to close all inlet and exhaust valving and with the right hand reversing chamber collapsed.

In FIG. 7, the power piston 23 has moved further right to approximately its stroke end position with all power piston carried valving or fluid passages closed, (i.e., 101, 102, 103 and 104) and stroke reversal has started.

In FIG. 7, with all inlet and exhaust passages closed, and the preferred fluid, oil being non-compressible or expandible, all motion ceases as the forces equalize. However, inlet valve 125 passage 141 remains open to continue to admit high pressure fluid into compartment 165 which fluid is passing through apertures 170, and along bore 169 into now collapsed chamber 131, via notch which collapse occurred as a result of stop 202 holding reversing piston 131' from further righthand movement while power piston 23 continued to move to the right to the stroke end.

Figure 8:
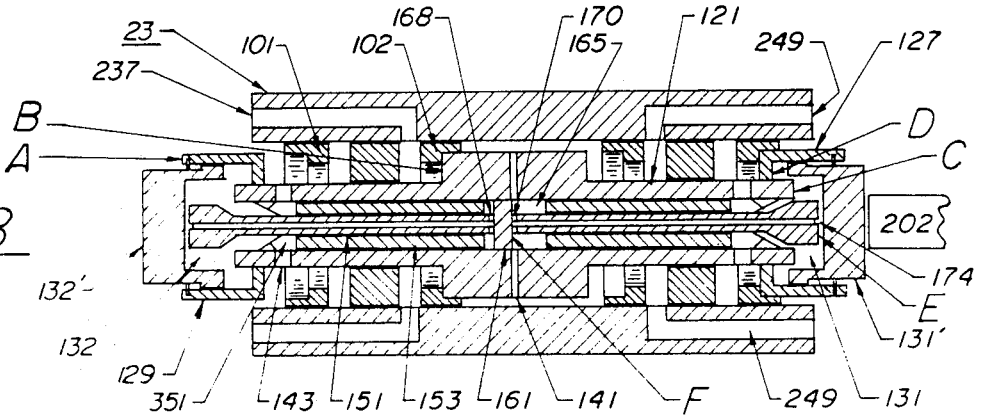
FIG. 8 is a sectional view similar to FIG. 7 except the power piston is in its extreme right hand position with inlet high pressure forcing the movable and rigid members left.

In FIG. 8, valve member 121 and rigid rod 151 have moved left as a result of the high pressure reacting against their right ends because reversing piston 131' is fixed. As soon as inlet valve 125 and righthand inlet valve seat 103 crack open, high pressure fluid rushes into conduit 249 and fills chamber 301 (FIG. 1) to urge piston 23 to the left.

Several important features insure reversal. First, rigid rod 151 is long enough to permit only one reversing piston chamber to collapse at any given time. Thus, chamber 132 remains uncollapsed and reversing piston 132' is held approximately in its lefthand end position while the righthand power stroke is completed. It is unnecessary to uncollapse chamber 132 or move piston 132' against the high pressure in chamber 226 (FIG. 1) while cracking.

The only areas to be moved against the pressure are the end of valve member 121, shown as area A, and a small portion of the end of inlet valve 125, shown as area B. This insures cracking and consequently reversal every time.

Also, the fluid pressure in the righthand collapsed chamber 131 is effective against all end area of rigid rod 151 and valve member 121 inside chamber 131. This pressure is effective against the end of valve member C within chamber 131, the inner end D of valve 127, the end E of rigid rod 151 and the end F of compartment 165. Hence a much greater area is exposed to the high pressure at the right end than the area A and B of the left end, thereby insuring cracking and reversal.

Also, chamber 132 is open to exhaust via passage 351 in rod sleeve 153, passage 143 in valve member 121 and along valve 129. This, piston 132' is shown moved slightly into chamber 132 in FIG. 8 as valve member 121 moved left relative thereto.

Since the valve and piston are symmetrical, the operation is the same for each stroke reversal.

Almost all parts have now been numbered, and it may be helpful to delineate the high and low pressure regions for the piston 23 moving right as shown in FIG. 4. The right side is connected to exhaust beginning with regions 361 and 362 and including 363, 364, 365 and 366. Chambers 131, 212 and 301 (FIG. 1) are all exhaust or low pressure.

The high pressure region to the left commences with inlet chamber 231, conduit 141, compartment 165, bore 167, chambers 132, 211 and 226 (FIG. 1). Also annular regions 378, 379, 380 and 381 and conduit 237 are filled with high pressure fluid.

This structure insures starting or continuous running any time and at depths where failure would be critical and require the pulling of the pump.

What is claimed is:

1. The method of reversing the flow of non-compressible pressure fluid for a piston in a cylinder comprising the steps of:

providing a movable valve means in the piston to alternate exhaust and application of pressure fluid to opposite ends of the piston;

establishing a pair of fluid isolated from each other collapsible chambers for high pressure fluid within the outer ends of said valve means by using a pair of unconnected spaced apart pistons respectively closing said chambers;

driving the piston to the end of a stroke by applying high pressure fluid to one end thereof and exhausting low pressure fluid from the other end;

collapsing one of said chambers at the end of one stroke by stopping its piston while preventing the opposite chamber from collapsing by a rigid member extending axially of the valve means between the two pistons; and, expanding the collapsed member to move the valve means by allowing the opposite chamber to collapse.

2. A method for pumping non-compressible fluids by automatically reciprocating a power piston in a cylinder using a uni-directional high pressure fluid flow, to establish power strokes in each direction comprising the steps of:

establishing a pair of spaced apart collapsible chambers fluid isolated from each other for respective collapsing toward the end of each power stroke;

valving the high pressure alternately to the exteriors of the piston ends to power said strokes; and, preventing collapse of both chambers at the same time to insure starting and continuous pumping.

3. The method of claim 2, wherein:

said chambers are closed by reversing pistons and are carried by the power piston and moved on power strokes until their respective pistons are stopped relative to the power piston whereby further movement of the power piston collapses the chamber spaced in the direction of power piston travel.

4. The method of claim 3, wherein:

said collapse prevention is achieved by disposing a rigid rod between the reversing pistons which is slidable with said power piston; and selecting the length of said rod to be equal to approximately the length between said pistons when only one of the chambers is collapsed.

5. The method of reversing the flow of non-compressible pressure fluid for a power piston in a power cylinder comprising the steps of:

providing a reciprocally movable valve means in the power piston to alternate exhaust and application of pressure fluid to opposite ends of the piston;

establishing collapsible chambers for high pressure fluid within the outer ends of said valve means;

driving the piston to the end of a stroke by applying high pressure fluid to one end thereof and exhausting low pressure fluid from the other end via said valve means;

selectively establishing high pressure fluid communication with the collapsible chambers;

collapsing one of said chambers at the end of one stroke while preventing the opposite chamber from collapsing; and, expanding the collapsed chamber to move the valve means by allowing the opposite chamber to collapse.

6. The method of claim 5 for pumping fluids comprising the further step of:

connecting said power piston to a reciprocating pump having an actuating member reciprocated by said piston to admit fluids to a pumping chamber on each stroke and deliver fluids from said pumping chamber on each stroke.

7. The method of claim 5 wherein the uncollapsed piston is not moved against pressure but only the area of the end of the valve means which is much smaller.

8. A reversing valve apparatus for alternately supplying non-compressible high pressure fluid to either end of a power piston in a cylinder while connecting the other end to exhaust comprising, in combination:

a movable valve member reciprocally slidable within said piston comprising exhaust valve and pressure fluid inlet valve portions communicating with each end of the power piston;

opposed reciprocally movable reversing pistons carried by the valve member and respectively oppositely extending beyond said valve member with said pistons defining collapsible chambers for selective communication with the supply of high pressure fluid via the inlet valve portion;

means including the valve member for establishing selective communication of the high pressure fluid with the collapsible chambers;

stop means spaced apart within the cylinder on opposite sides of the piston for respectively restricting the motion of said reversing pistons through abutment thereof toward the end of opposite piston strokes to decrease the abutted piston collapsible chamber by inward movement of the associated reversing piston relative to the moving piston; and, rigid means slidable in the valve member between the reversing pistons for preventing collapse of the uncollapsed chamber, during reversal of the power piston.

9. The device of claim 8 wherein said apparatus comprises:

a pump piston;

a pump cylinder housing containing said pump piston and being in communication with said cylinder housing;

a rigid connection between said power piston and said pump piston for reciprocating the latter; and, valve means in said pump housing for admitting the fluid to be pumped to said pump piston during each stroke.

10. The device of claim 9 wherein said apparatus further comprises:

operating chambers on opposite ends of the inlet valve portion within said cylindrical housing for the power piston; and, said inlet valve portion being movable in opposite directions to admit high pressure fluids respectively to said operating chambers on alternate strokes.

11. Apparatus for establishing reciprocating pumping motion automatically from a uni-directional high pressure fluid flow comprising, in combination:

first, second and third means assembled together and each reciprocally movable relative to the other;

a cylinder housing said means;

said first means comprising a cylindrical power piston, together with the second means, reciprocally slidable between spaced apart closures within said cylinder in response to high pressure fluid flow to generate said pumping motion; cylinders and reversing pistons forming collapsible chambers and an intermediate portion slideable within the power piston;

an inlet high pressure passage to each chamber via the first, second and third means when said means are in two different relative positions;

said third means partially forming said chambers and extending between said pistons and being of a length to prevent collapse of one chamber when the other is collapsed;

stop means between the reversing pistons and adjacent closures for abutting engagement with said closures and said reversing pistons whereby further motion of an abutted reversing piston is stopped until said inlet passage extends to the associated collapsed chamber forcing the second and third means to receive the stroke.

12. Apparatus for pumping non-compressible fluids by automatically reciprocating motion derived from a uni-directional high pressure fluid flow, establishing power strokes in each direction comprising, in combination:

a cylindrical housing;

a power piston reciprocally movable in said housing;

means carried by said piston for establishing a pair of spaced apart fluid isolated from each other collapsible chambers for respective collapsing toward the end of the power strokes;

means for valving the high pressure alternately to the exteriors of the piston ends to power said strokes; and, means for preventing collapse of both chambers at the same time to insure starting and continuous pumping.

13. The apparatus of claim 12, comprising:

reversing pistons closing said chambers carried by said power piston; and, means for stopping said reversing pistons on successive strokes, permitting the power piston to continue thereby collapsing the chamber in the direction of power stroke movement.

14. The apparatus of claim 13, wherein:

said means for preventing collapse comprises a rigid rod within the power piston extending between said reversing pistons and having a length to permit only one chamber to collapse at any given time.

15. A reversing valve apparatus for alternately supplying high pressure fluid to either end of a power piston, including fluid exhaust and inlet passages in a cylinder while connecting the other end to exhaust comprising, in combination:

a movable valve member reciprocally slidable within said piston comprising exhaust valve and pressure fluid inlet valve portions communicating with each end of the power piston and said passages in the piston;

opposed reciprocally movable reversing pistons carried by the valve member and respectively oppositely extending beyond the valve member with said reversing pistons defining respective collapsible chambers for communication with a supply of high pressure fluid via the inlet valve portions and for exhaust via the exhaust valve portions;

stop means at least partly spaced apart and fixed within the cylinder beyond opposite ends of the power piston for respectively restricting the motion of said reversing pistons through abutment toward the end of opposite power piston strokes to decrease the restricted motion piston collapsible chamber by inward movement of the associated reversing piston relative to the moving power piston;

rigid means movable relative to the valve member extending between said reversing pistons of a length to prevent both reversing pistons from collapsing their chambers simultaneously whereby reversal of the power piston is accomplished without substantial energy loss due to overcoming reversing piston chamber collapse; and, said rigid means, together with said inlet valve portions, selectively defining passageways for high pressure fluid flow to said chambers to initiate said reversing of the power piston.

16. The apparatus of claim 15, wherein:

the ends of the valve member comprise open cylinders for receiving the reversing pistons respectively to define said chambers there between and function as exhaust valves.

17. The apparatus of claim 16, wherein:

said valve member includes an open bore for receiving at least part of said rigid means; and, a portion of said passageways for high pressure fluid flow extending as a bore in the rigid means to one chamber and another portion extending as a bore in the rigid means to the other chamber.

18. The apparatus of claim 17, wherein:

said rigid means comprises partition means between said passageway portions movable by the rigid means relative to a high pressure inlet passage through the valve member from a high pressure inlet passage of the power piston to select the reversing piston chamber to receive high pressure fluid by selecting fluid communication with one of said portions.

19. The apparatus of claim 18 further comprising:

a plurality of flanged rings fixed within the power piston at spaced apart positions to comprise valve seats;

a pair of said rings respectively fixed near the outer ends of the power piston to serve as exhaust seats for the inner peripheral portions of the valve member exhaust valve cylinders.

20. The apparatus of claim 19, wherein:

said valve member comprises an enlarged central portion movable relative to the power piston between a second pair of said rings serving as valve seats for the enlarged portion to high pressure inlet fluid to the respective outer ends of said power piston.

21. The apparatus of claim 20, wherein said rigid means comprises a pair of cylindrical spacers seated about a rod including said bore in spaced relation to form an annular compartment about the central region of said rod within said valve member;

said partition carried by the rod snugly fitting the compartment to seal it on either side of the valve member high pressure inlet passage, thereby to direct the high pressure selectively to said collapsible chambers via said bore portions.

22. The apparatus of claim 21, wherein:

the outer ends of said rod are enlarged to function as exhaust valves for said chambers;

said sleeves respectively comprising the valve seats therefor and providing exhaust passages from the chambers to the exhaust valve parts formed by the valve member end cylinders.

23. The apparatus of claim 22, wherein:

the stop means comprise a slidable stop member between the reversing pistons and the adjacent cylinder ends;

guide means carried by the slidable stop members penetrating the power piston ends respectively to strike said fixed stop means and abut the adjacent reversing piston.

* * * * *